United States Patent [19]

Egeland

[11] Patent Number: 4,958,391

[45] Date of Patent: Sep. 25, 1990

[54] SWAY BED SUPPORT FRAME

[76] Inventor: Byron Egeland, General Delivery, Medicine Hat, Alberta, Canada, T1A 7E4

[21] Appl. No.: 299,535

[22] Filed: Jan. 23, 1989

[30] Foreign Application Priority Data

May 4, 1988 [CA] Canada ..... 565948
Oct. 5, 1988 [CA] Canada ..... 579394

[51] Int. Cl.[5] ..... A45F 3/24

[52] U.S. Cl. ..... 5/127; 5/414; 297/273

[58] Field of Search ..... 5/127, 128, 129, 120, 5/201, 99 B, 414; 297/273

[56] References Cited

U.S. PATENT DOCUMENTS 382,648 5/1888 Hussey .
404,614 6/1889 Gifford .
465,017 12/1891 Eller .
626,763 6/1899 Linkletter .
749,731 1/1904 Hall ..... 5/82
823,386 6/1906 Benbury .
1,675,221 6/1928 Knappe .
2,353,220 7/1944 Charlop ..... 5/128
4,538,309 9/1985 Gunter ..... 5/99 B
4,704,750 11/1987 Wheelock ..... 5/127
4,750,223 6/1988 D'arcy et al. ..... 5/98 R

FOREIGN PATENT DOCUMENTS 2556947 6/1985 France .
74087 4/1985 Israel .
8505028 11/1985 PCT Int'l Appl. .

*Primary Examiner*—Alexander Grosz
*Attorney, Agent, or Firm*—Robert W. B. Bailey

[57] ABSTRACT

This invention relates to a swaying bed suppport, while such supports are known they either have a massive base structure or require fixing to the ground or floor. The swaying bed support of the invention comprises two end supports and a lower linking assembly, the bed itself is generally conventional and suspended from the end frames by chains, ropes and the like. The linking assembly and end supports are detachably secured to each other so they can be readily dismantled for movement between rooms and residences. The lower linking assembly can itself be dismantlable. This frame is sufficiently rigid to enable the bed to sway without distorting the frame. Optionally an upper linking assembly may be present, which may be two parallel arched members joined by cross pieces, which may be used to hold a canopy, or it may be two diagonal arched members meeting at a cross piece. The upper linking assembly is desirably detachable and disassemblable.

9 Claims, 21 Drawing Sheets

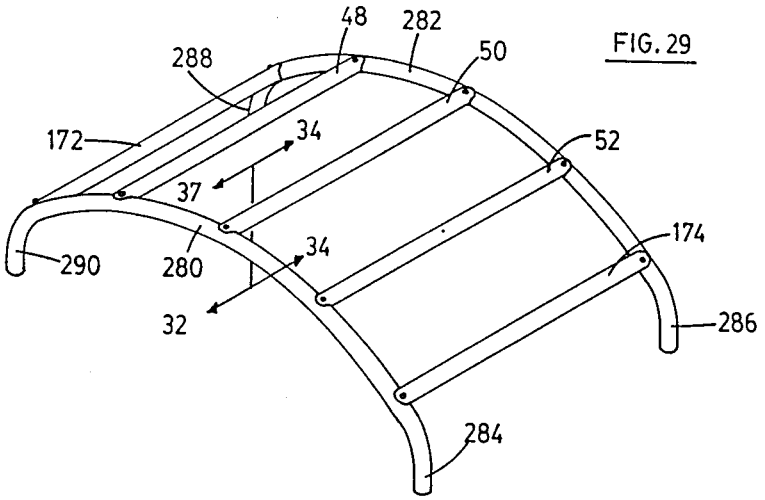
FIG. 29
FIG. 30
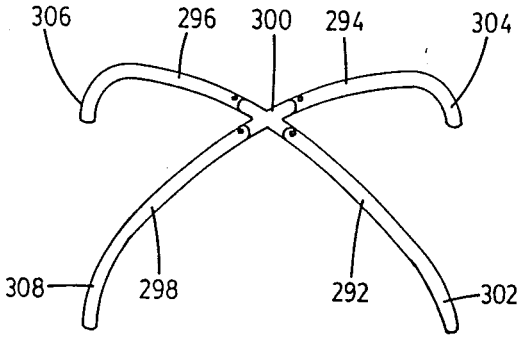

SWAY BED SUPPORT FRAME

This invention relates to bed frames. In particular it relates to supports for suspending beds or mattresses from, to allow the bed or mattress to sway gently rather than swing.

DESCRIPTION OF THE PRIOR ART

Swings and hammocks are old and known. Two post support arrangements are known. U.S. Pat. No. 382,648, issued May 8, 1888, to Hussey, U.S. Pat. No. 404,614, issued June 4, 1889 to Gifford, U.S. Pat. No. 626,763, issued June 13, 1899 to Linkletter, all teach a two post arrangement to suspend a swing seat or hammock, which have a cross piece or structure to bear a canopy. U.S. Pat. No. 1,675,221, issued June 26, 1928 to Knapfe, teaches a two post arrangement to suspend a hammock frame. International patent application 8505028, published Nov. 21, 1985 to Barthlen, teaches a swinging bed supported by paired corner bars joined to form two pivots, at each end of the bed, these pivots are suspended from a common axis, presumably supported by a double post arrangement. French Demande 2556947 published June 28, 1985 to Hernecq, teaches a two post support system for a bed frame. Four post support systems are taught in U.S. Pat. No. 823,386 issued June 12, 1906 to Benbury, which comprises a double gallows arrangement mounted on a rectangular frame. U.S. Pat. No. 4,704,750 issued Nov. 10, 1987 to Wheelock, teaches a rectangular frame having four corner posts from which ropes or chains suspend a bed frame. Israeli Pat. No. 74087, published Apr. 30, 1985 to Hovav, teaches a four post support system having ropes or chains suspending the bed from the posts.

DESCRIPTION OF THE INVENTION

In the description of the invention, the beds and bed frames that are suspended are in general conventional beds and bed frames. Conventional mattresses on conventional box springs or conventional mattresses on other conventional bed frames may be used in the practice of the invention. The bed frame proper will have attachment means for suspending means mounted on the frame.

It is a principal object of the invention to provide an improved swaying bed support means, other objects will hereinafter become apparent.

In a broad aspect the invention is directed to support means for swaying rectangular bed frame means comprising opposed head and foot members, the head and foot members each comprising spaced apart first attachment means for suspension means for the bed frame, and linking means to maintain the head and foot members in relative position, whereby the first attachment means remain in relative position when the bed frame is suspended therefrom by suspension means attached to second attachment means adjacent the corners of the frame. Preferably the linking means comprises upper and lower linking means, which may be detachably secured to the head and foot members.

The head and foot generally horizontal cross members are conveniently of substantially equal height, which is often adjacent the top of the supporting upright members, although this is not always so in every embodiment. Also although this is not a general requirement in view of the different construction possibilities, the head and foot cross members may be demountably attached to the paired upright members.

The opposed head and foot members may each include a pair of generally upright members having connecting upper and lower generally horizontal cross members, the lower cross members being of substantially equal vertical height up the upright members adjacent the bottom of the upright members, the upper cross members being of substantially equal vertical height up the upright members, the lower linking means comprising lower generally horizontal linking means detachably secured to the lower cross members, and substantially perpendicular thereto, the upper cross members comprising the spaced apart attachments to attach suspension means for the bed frame adjacent the upright members, the upper linking means comprising an arcuate upper assembly detachably secured to the upright members adjacent the top of the uprights at a height at least equal to that of the upper cross member. This arcuate assembly may be selected from the group consisting of first and second arcuate assemblies, the first arcuate assembly comprising parallel arcuate members connecting a head upright member to an opposed foot upright member, transverse member means connecting the parallel arcuate members and detachably secured thereto, the transverse member means being substantially parallel to the upper cross members and dividing the arcuate length of the parallel arcuate members between the upright members into approximately equal lengths, and the second arcuate assembly comprising diagonal arcuate members connecting a head upright member to a transverse foot upright member, the diagonal arcuate members forming an intersection approximately equidistant from the upright members, and the lower generally horizontal linking means being selected from the group consisting of first and second horizontal linking means, the first horizontal linking means comprising a single substantially horizontal member detachably secured to the lower cross members at the midpoints thereof, and substantially perpendicular thereto, and the second horizontal linking means comprising paired parallel substantially horizontal members detachably secured to the lower cross members spaced apart from the midpoints thereof, and substantially perpendicular thereto. More preferably the first arcuate assembly comprises a plurality of transverse members connecting the arcuate members dividing the arcuate length of the parallel arcuate members between the upright members into approximately equal lengths, and the second arcuate assembly comprises center piece means approximately equidistant from the upright members, connecting the diagonal arcuate members. Preferably the first arcuate assembly comprises a plurality of transverse members the plurality being selected from the group consisting of three and five, and the second arcuate assembly comprises diagonal arcuate members detachably secured to the center piece, the center piece including four conjoined arms adapted to receive the diagonal arcuate members.

Again the head and foot members may each comprise generally horizontal cross member means attached to paired generally upright members, lower linking means comprising generally horizontal linking means attached to the generally upright members adjacent their base, connect the head member to the foot member, and the generally horizontal cross members comprises the first attachment means to attach the suspension means for the bed frame. The lower linking means connecting the generally upright members can be selected from the group consisting of first, second and third lower linking means, the first lower linking means comprising parallel linking members connecting opposed upright members, the second lower linking means comprising diagonal linking members connecting diagonally opposed upright members, and the third lower linking means comprising head lower cross member means connecting the head paired uprights adjacent their base, foot lower cross member means connecting the foot paired uprights adjacent their base, and means connecting the head lower cross member means to the foot cross member means. Conveniently the first lower linking means additionally comprises transverse means connecting the parallel linking members, and the second lower linking means additionally comprises center piece means approximately equidistant from the upright members connecting the diagonal linking members, which may be detachably secured to the center piece means, which comprises four arms adapted to receive the base members, the four arms being conjoined. The head and foot horizontal cross members may have integral downward generally upright members at each end comprising circular tubes, and the second lower linking assembly may comprise four intersecting horizontal linking members having integral upward generally upright members at the outer ends thereof, comprising circular tubes, these upward upright members having a terminal external diameter adapted to fit snugly within the interior of the downward upright member, while the center piece arms can comprise tubing of lesser diameter adapted to fit snugly within the inner ends of the four intersecting base horizontal linking members.

Again each of the paired upright member may comprise an upward extension adapted to receivably engage attachment means, which may be provided by an outer upright member adjacent to the paired upright members and attached thereto. In this case, the head and foot horizontal cross members have integral downward generally upright members at each end comprising circular tubes, and the lower linking assembly comprises four intersecting diagonal linking members having integral upward generally upright members at the outer ends thereof and comprise circular tubes, the upward upright members having a terminal external diameter adapted to fit snugly within the interior of the downward upright member, the intersecting diagonal linking members being detachably secured to center piece means, which comprises four arms adapted to receive the base members, the four arms being conjoined, the center piece arms comprising tubing of lesser diameter adapted to fit snugly within the inner ends of the four intersecting base horizontal linking members, the outer upright members comprise circular tubes having a terminal lesser external diameter adapted to fit within a circular tube of similar internal diameter. An upper assembly can be attached to the upright upward extensions selected from the group consisting of first and second arcuate assemblies, the first arcuate assembly comprising parallel arcuate members connecting a head upright member to an opposed foot upright member, transverse member means connecting the parallel arcuate members and detachably secured thereto, the transverse member means being substantially parallel to the upper cross members and dividing the arcuate length of the parallel arcuate members between the upright members into approximately equal lengths, and the second arcuate assembly comprising diagonal arcuate members connecting a head upright member to a transverse foot upright member, the diagonal arcuate members forming an intersection approximately equidistant from the upright members, the arcuate members each comprise integral downward generally vertical members at the outer ends thereof comprising circular tubes, the downward vertical members having a terminal internal diameter adapted to fit the lesser external terminal diameter of the outer upright members, whereby the upper arcuate assembly is attached to the support means, each the outer upright members being detachably secured to the adjacent cross member downward generally upright member, and to the adjacent linking member integral upward generally upright member. Alternatively hollow balls may be fitted onto the tops of the outer upright members.

Alternatively when the support means has upright extensions each comprising an outer upright member adjacent to the paired upright members and attached thereto, the outer upright members may be connected by peripheral flexible means, which may be cord, or metal wire. Preferably the head and foot horizontal cross members have integral downward generally upright members at each end comprising circular tubes, and the lower linking assembly comprises four intersecting diagonal linking members having integral upward generally upright members at the outer ends thereof and comprise circular tubes, the upward upright members having a terminal external diameter adapted to fit snugly within the interior of the downward upright member, the intersecting diagonal linking members being detachably secured to center piece means, which comprises four arms adapted to receive the base members, the four arms being conjoined, the center piece arms comprising tubing of lesser diameter adapted to fit snugly within the inner ends of the four intersecting base horizontal linking members, the outer upright members comprise circular tubes connected by peripheral flexible means at the tops thereof.

The invention in another aspect is directed to a kit for a support means for a rectangular swaying bed frame comprising head and foot members each comprises generally horizontal cross member means attached to paired generally upright members, lower linking means comprising generally horizontal linking means adapted to be demountably attached to the generally upright members adjacent their base, thus connecting the head member to the foot member, the generally horizontal cross members comprising first attachment means to attach the suspension means for the bed frame. This kit can additionally comprise an upper arcuate linking assembly selected from the group consisting of first and second arcuate assemblies, the first arcuate assembly comprising parallel arcuate members connecting a head upright member to an opposed foot upright member, transverse member means connecting the parallel arcuate members and detachably secured thereto, the transverse member means being substantially parallel to the cross members and dividing the arcuate length of the parallel arcuate members between the upright members into approximately equal lengths, and the second arcuate assembly comprising diagonal arcuate members connecting a head upright member to a transverse foot upright member, center piece means approximately equidistant from the upright members, connecting the diagonal arcuate members, the arcuate members being adapted at the outer end to be demountably attached to the upright members. Preferably the first arcuate assembly is disassembled into parallel arcuate members, and transverse means adapted to be demountably attached to the parallel arcuate members, and the second arcuate assembly is disassembled into diagonal arcuate members and a center piece means adapted to be demountably attached to the diagonal arcuate means.

The support means may include a rectangular bed frame, the bed frame comprising two parallel side pieces extending between the head and foot members, each having attached suspension means adjacent the head and foot ends of the side piece, and two cross pieces connecting the side pieces, the cross pieces being demountably attached to the side pieces adjacent their ends, the cross pieces comprising two aligned portions detachably securable together at a plurality of positions whereby the cross pieces are adjustable in length. This may be achieved when each the cross piece comprises a first aligned portion having a plurality of spaced apart holes at its inner end, and a second aligned portion having at least one hole at its inner ends, first and second aligned portions being demountably connected together by bolt means passing through one of the plurality of holes in the first aligned portion and through one hole in the second aligned portion, whereby the cross pieces are adjustable in length, and the bed frame is adjustable in width.

It is desirable that the invention be in kit form, or at least is dismantlable into readily transportable components, for ease of moving the support inside or between residences.

When the upper arcuate assembly comprises parallel arcuate members, besides providing extra stability to the head and foot members, the arcuate assembly can also be used to hang a canopy.

The invention, herein described, has been noted to have the property that the bed when attached to the support sways gently from four points rather than swings from two points. As the bed frame is moved from a rest position the center of gravity is placed from the rest position and it is noted that regardless of the suspension means it is difficult for a person on the bed to displace the bed to a configuration so that a suspension means is vertical, and more difficult to displace it much beyond a vertical position of the suspension means. The bed motion of a bed suspended from the structure of this invention is thus damped compared to that of a two point swing suspension such as a swing or hammock.

DESCRIPTION OF THE PREFERRED EMBODIMENTS

Preferred embodiments of the invention are illustrated in the drawings, where:

FIGS. 29 and 30 show alternative embodiments of the upper assemblies of FIGS. 1 to 8 and 20;

Figure 1:
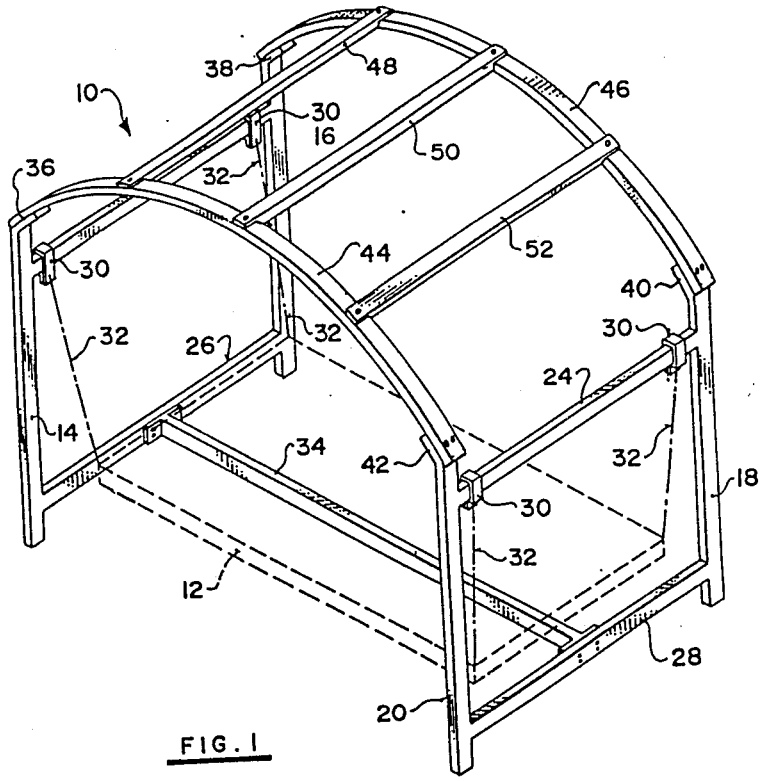
FIG. 1 is a perspective view of an embodiment of the invention.
Figure 2:
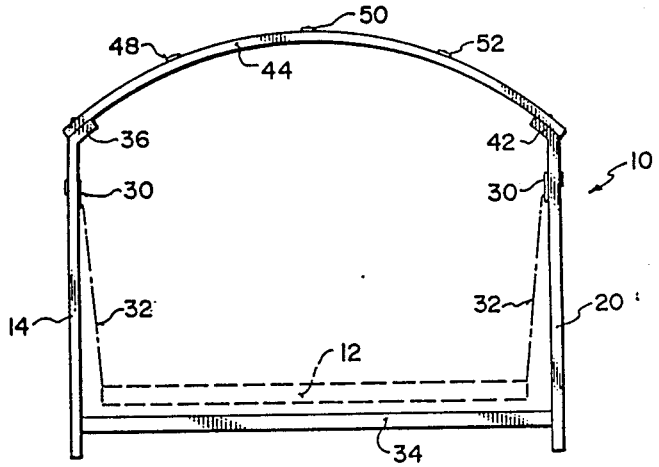
FIG. 2 is a side view thereof.
Figure 3:
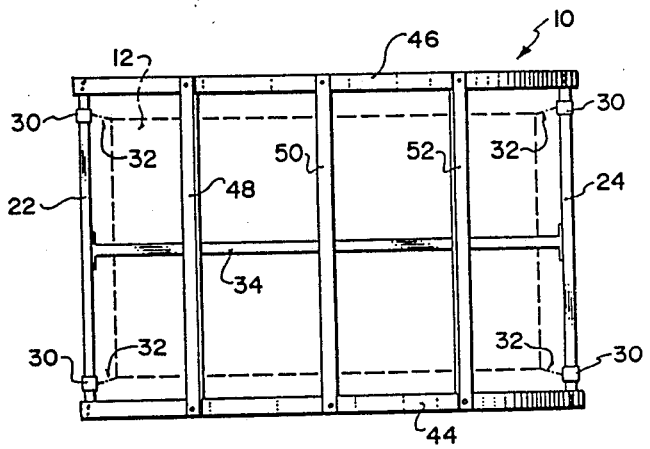
FIG. 3 is a top view thereof.
Figure 4:
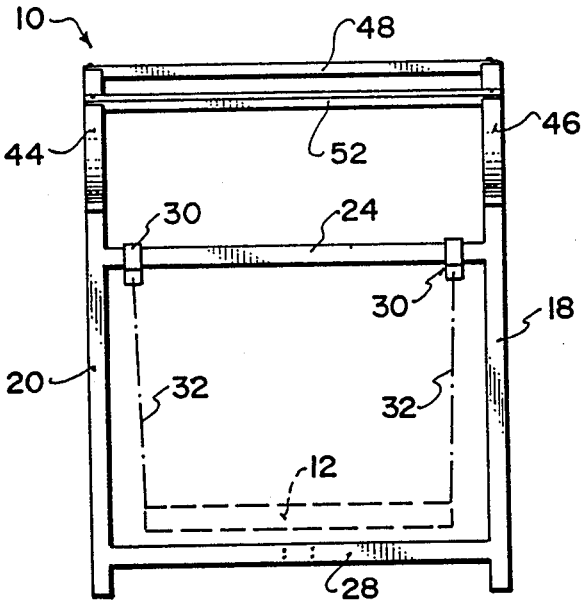
FIG. 4 is an end view thereof.
Figure 5:
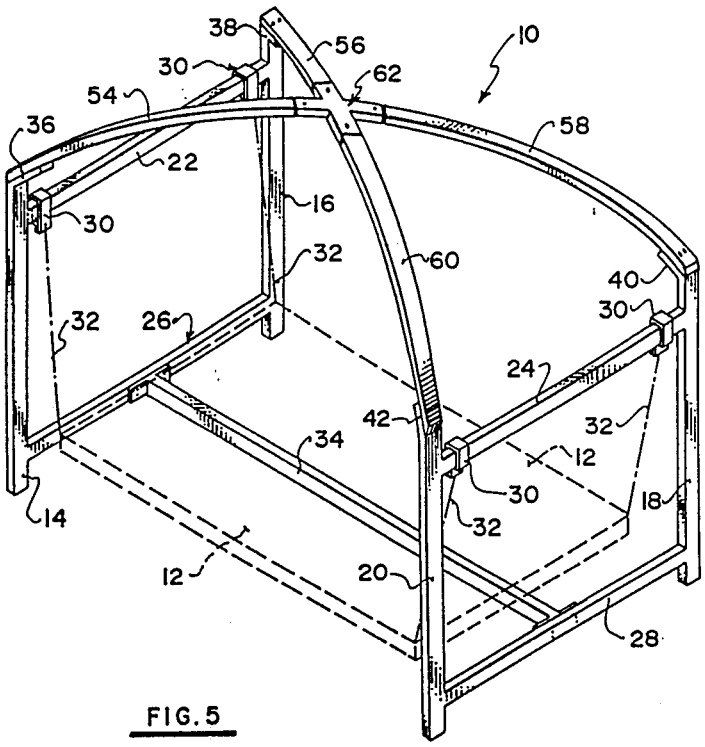
FIG. 5 is a perspective view of another embodiment of the invention.
Figure 6:
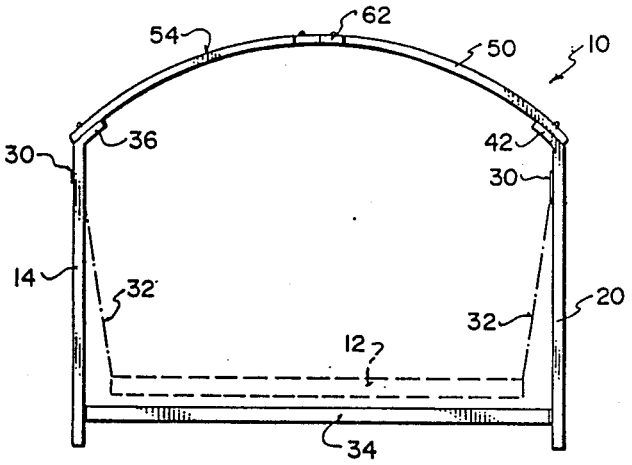
FIG. 6 is a side view thereof.
Figure 7:
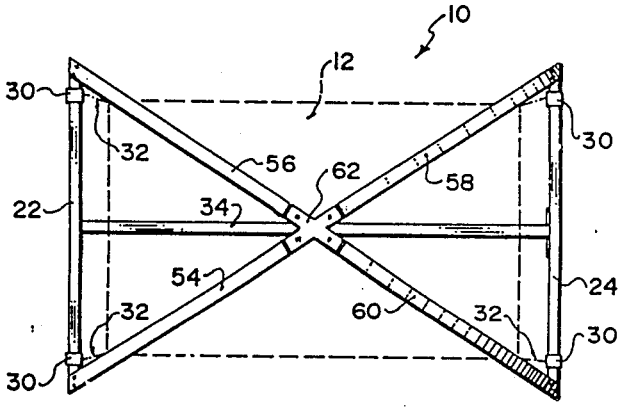
FIG. 7 is a top view thereof.
Figure 8:
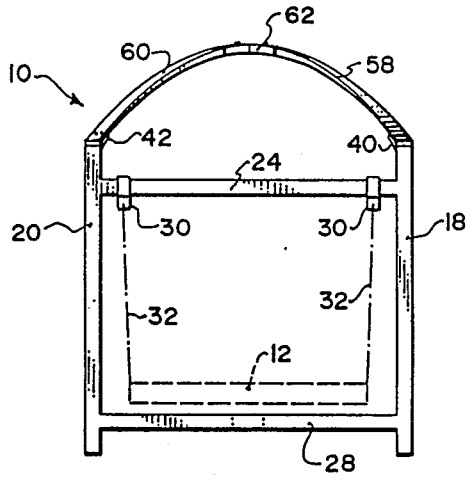
FIG. 8 is an end view thereof.

In FIGS. 1 to 8, the numeral 10 generally indicates the support frame, 12 indicates the position of the bed frame, which is conventional in nature. Support frame 10 includes four generally upright support posts 14, 16, 18, 20, (these uprights are preferably 1.4 m. or 4.5 ft high) joined by upper horizontal cross struts 22 and 24, and lower horizontal cross struts 26 and 28, these struts are integral as shown, but may be secured to the uprights by fastening means depending on frame material used and convenience any suitable conventional fastening means can be used screws, rivets, bolts, nails, dowels and the like as would be appreciated by those skilled in the art. The lower cross struts are near the bottom of the support posts while the upper are near the top of the support posts, (preferably the distance between the external edges of the head supports is about 1.8 m. or 5.8 ft.). Conventional means 30, brackets as shown, but again may be of any suitable style, such as eye bolts, hooks and the like, are fixed to upper cross struts from which depend chains, ropes or other conventional suspending means 32 suspend bed frame 12, the suspending means are anchored to the bed frame by conventional anchoring means (not shown) which may be identical or different to those on the upper cross struts. Longitudinal strut 34 connecting lower cross struts 26, 28 is attached by conventional fastening means at their mid point (this longitudinal strut is preferably about 2.3 m. or 7.5 ft long). At the top of upright posts 14, 16, 18, 20, have respective upper portions 36, 38, 40, 42, forming an inclined plane toward the other end of the bed frame. In the embodiment of FIGS. 1 to 4 arcuate members 44 and 46 join uprights 14 and 20 and 16 and 18 respectively. These are fastened to the upper portions 36, 38, 40, 42 by conventional fastening means. Cross members 48, 50, 52 interconnect arcuate members 44, and 46.

When in use a bed frame is suspended by suspending means 32. The weight is fairly evenly distributed among the support posts. Any movement of persons lying on the bed causes the bed to sway. The bed frame used is conventional and can be used to support a mattress or box spring according to taste. The upper frame—arcuate members 44, 46 and cross members 48, 50, 52—keeps the tops of the supports and thus the anchors 30 in relative position while longitudinal strut prevents relative movement of cross struts 26 and 28 and the frame from walking.

In the embodiment of FIGS. 5 to 8 a different arrangement of arcuate members is utilised. Diagonal arcuate members 54, 56, 58, 60 are mounted on upper portions 36, 38, 40, 42, of supports 14, 16, 18, 20 respectively. Center piece 62 is adapted to receive inner ends of arcuate members 54, 56, 58 and 60 which are conventionally fastened thereto. The upper frame—arcuate members 54, 56, 58, 60 and center piece 62—serve the same purpose as the upper frame as that of FIGS. 5 to 8. The arcuate frame itself preferably has a curvature such that the top of the arcuate frame is preferably about 0.45 m or 1.5 ft. above its attachment point to the uprights. The dimensions given above are preferred only, they can be easily changed to accommodate various sizes and styles of bed, commonly available beds range from 0.75 m to 2 m (2.5 to 6.5 ft) in width and 1.8 m to 2 m (6 to 6.5 ft) in length and further variations are commercially available. The end frames, bottom strut, and top assembly are detachable, so that the frame can be moved from room to room and residence to residence. The preferred material for the structure is metal tubing 1 inch×2 inch and 16 mil thick (2.5 cm×5 cm, and 0.04 cm thick). Any other suitable structural material of appropriate properties may be used as would be realised by those skilled in the art.

Figure 9:
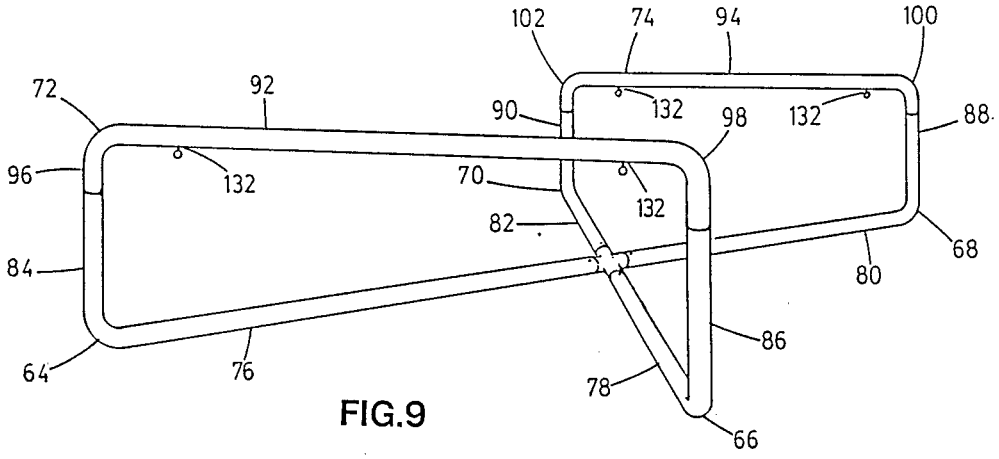
FIG. 9 is a perspective view of a further embodiment of the invention.
Figure 10:
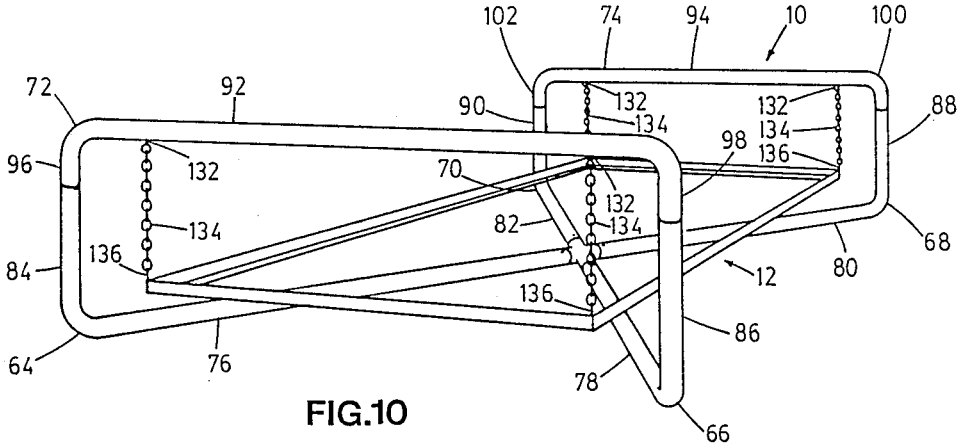
FIG. 10 is a perspective view of the same embodiment with a bed frame shown.
Figure 13:
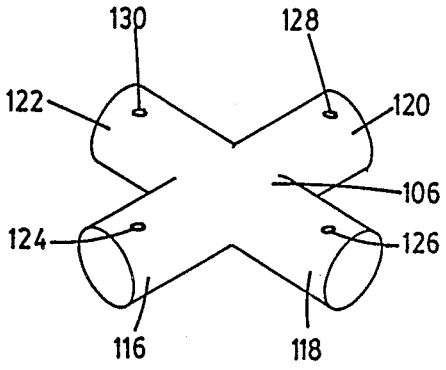
FIG. 13 is a view of a component shown in FIGS. 9 and 10.
Figure 12:
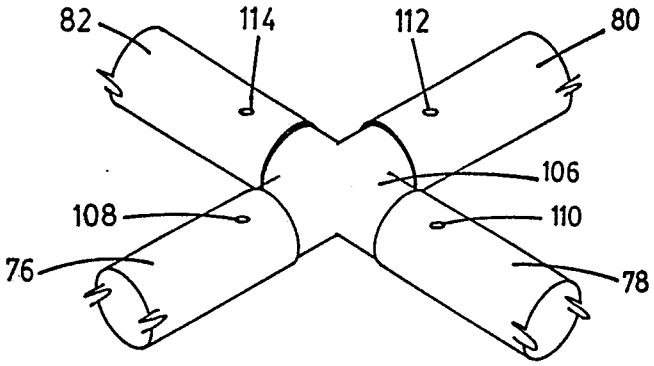
FIG. 12 is a view of a detail of the same embodiment showing details of the base.
Figure 11:
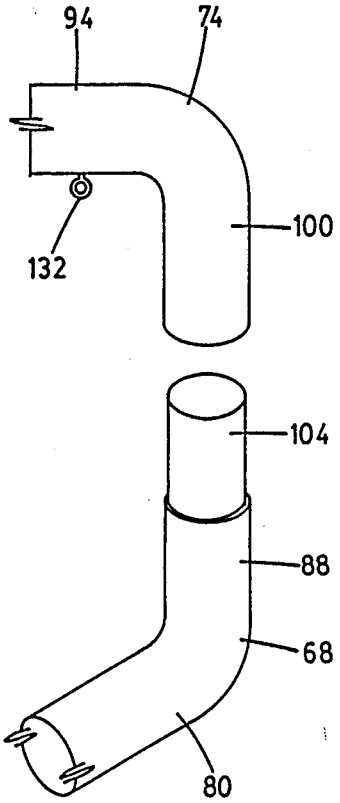
FIG. 11 is a view of a detail of the same embodiment showing details of an base.

In FIGS. 9 to 13, the numeral 10 generally indicates the support frame, 12 indicates the position of the bed frame, which is conventional in nature. Support frame 10 includes four lower support members 64, 66, 68, 70, and upper support members 72 and 74. The lower support members 64, 66, 68, 70, each comprises a generally horizontal portion 76, 78, 80, and 82 respectively and a generally upright portion 84, 86, 88, and 90 respectively. The upper support members 72 and 74, each have a generally horizontal portion 92 and 94 respectively, and paired generally upright downward end portions 96 and 98, and 100 and 102. As shown in FIG. 13 lower support member 68's generally upright portion 88 has a terminal upward male projection 104 adapted to engage the interior of upper support member 72's downward end portion 100. All the lower support members upright portions similarly engage the downward end portions of the upper support members. The lower support members 64, 66, 68, 70 and the upper support members 72, and 74 are preferably made from 10 gauge steel tubing of 2 inch (5 cm) diameter. In FIGS. 11 and 12 is shown the junction of lower support member portions 76, 78, 80 and 82 through cross member 106, securing pins or bolts 108, 110, 112 and 114 pass through portions 76, 78, 80 and 82 respectively and through arms 116, 118, 120 and 122 respectively of cross member 106, through holes 124, 126, 128, and 130 respectively. Desirably bolts 108, 110, 112, and 114, are Allen bolts and holes 124, 126, 128, and 130 are provided by suitable nuts welded to cross member 106. This arrangement provides a firm but dismantlable support frame. Securing pins or bolts 108, 110, 112, 114 may be replaced by any suitable conventional fastening means depending on frame material and convenience—screws, rivets, bolts, nails, dowels and the like as would be appreciated by those skilled in the art. Upper support members 72 and 74, have eye bolts 132 from which suspend chains 134 attached by eye bolts 136 to bed frame 12 at the corners, eye bolts 132 are preferably secured to upper support members 72 and 74, by drilling holes in the upper support members and then welding the eye bolts 132 in position. Eye bolts 136 can be secured in the same fashion to bed frame 12, or they can be secured in the usual fashion with a nut. Eye bolts 132 and 136 may be replaced by any suitable conventional attachment means such as brackets, hooks and the like 32 suspend bed frame 12, the which may be identical or different on frame 12 and support members 72 and 74. Chains 134 may be replaced by any other conventional suspending means such as ropes, nylon ropes, cords and the like. Frame 12 as shown is angle iron, which is suitable for conventional box springs, however virtually any type of bed of any size can be so suspended, including mattresses, water beds, and the like, provided that the bed utilised comprises suitable support means for the bed chosen.

Figure 14:
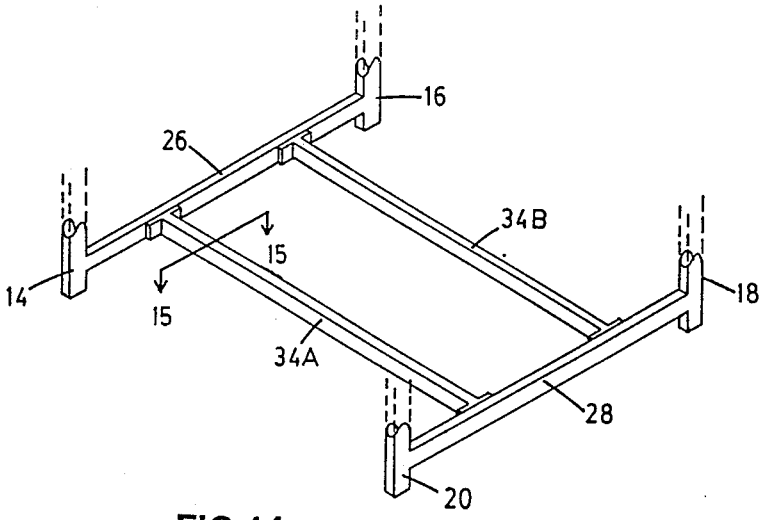
FIG. 14 is a view of an alternative embodiment of the base of the embodiments shown in FIGS. 1 to 8.

In FIG. 14, is shown an alternative embodiment of the base arrangement shown in FIGS. 1 to 8. In this embodiment the single strut 34 connecting cross struts 26 and 28 is replaced by paired struts 34A and 34B. This double strut arrangement is preferred over the single strut arrangement of FIGS. 1 to 8, as it makes the support frame more rigid.

Figure 15:
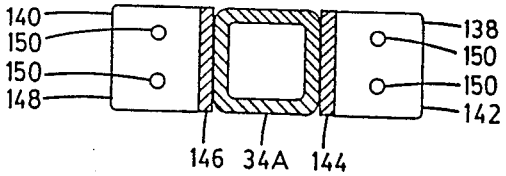
FIG. 15 is a part sectional part elevational view of the end of a longitudinal strut.

FIG. 15 shows a detail of the end of strut 34A, which is identical to the ends of struts 34 and 34B. Strut 34A is flanked at the end by brackets 138 and 140, these brackets have flat portions 144 and 146 respectively abutting and welded to strut 34A, there are also flat portions 142 and 148, perpendicular to 144 and 146 having paired holes 150 for bolts, to attach the struts to cross struts 26, 28, etc.

Figure 16:
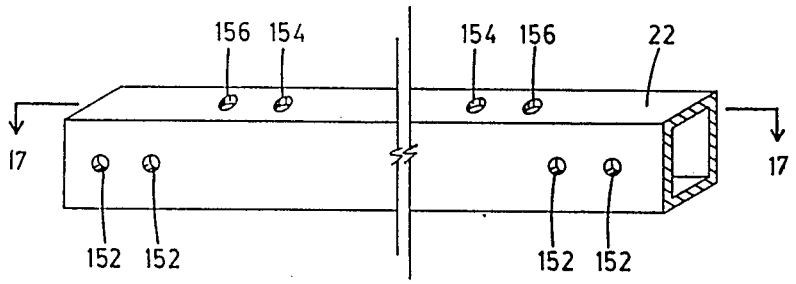
FIG. 16 shows a view of an alternative embodiment of an upper cross member.
Figure 17:
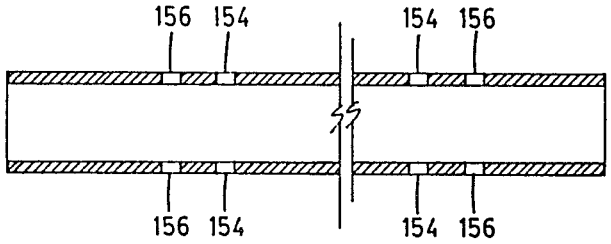
FIG. 17 shows a sectional view of the member of FIG. 16.

FIGS. 16 and 17, shows one alternative form of upper cross members 22, or 24, two pairs of horizontally aligned holes 152 are provided to allow attachment to uprights, these can receive bolts and the like, paired inner holes 154 and outer holes 156 are provided in the upper surface and lower surface of the member these are adapted to receive eyebolts, to hang suspending means from, the inner pair of holes are used with a regular size bed, width 48 in. (1.2 m), while the outer pair are used with larger size beds, queen, width 60 in. (1.5 m), and king, width 78 in. (2 m).

Figure 18:
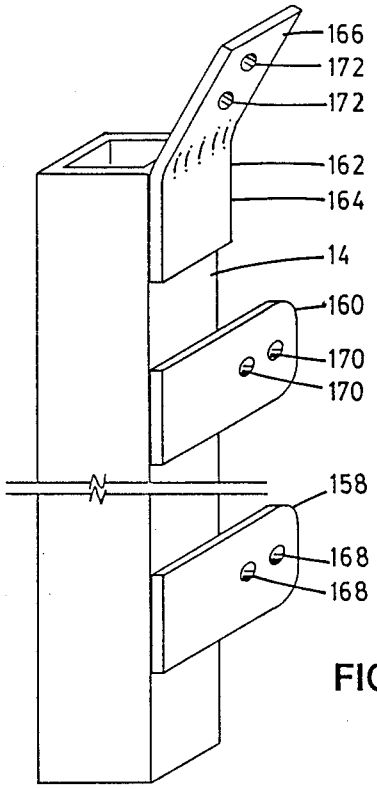
FIG. 18 shows a view of an alternative embodiment of an upright member.

FIG. 18 shows an alternative embodiment of upright member 14 has attached lower tab 158 adapted to receive bolts in paired holes 168 to attach lower cross member 26 and upper tab 160 adapted to receive bolts in paired holes 170 to attach upper cross member 22, tabs 158 and 160 have rounded projecting corners, tab 162 has flat portion 164 abutting member 14 and projecting flat portion 166 angled to receive arcuate member 44, portion 166 has paired holes 172 adapted to receive bolts to attach arcuate member 36. Tabs 158, 160 and 162 are welded to upright 14.

Figure 19:
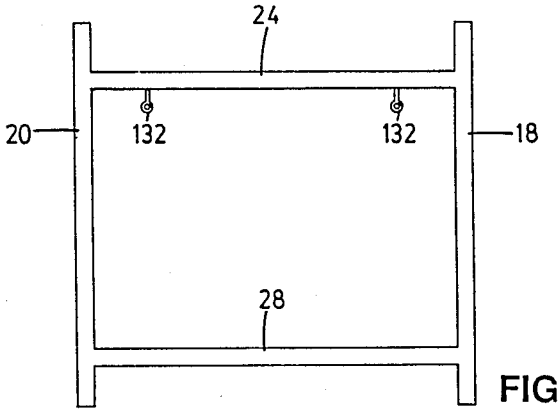
FIG. 19 shows an alternative embodiment of the end frame of FIGS. 1 to 8.

FIG. 19 shows upper cross member 24 in lower position than the same cross member in the embodiments of FIGS. 1 to 8, while eyebolts 132 are used instead of brackets 30. This arrangement allows the cross member to be 4 ft. (1.2 m) above floor level, rather than 4.5 ft. (1.4 m), which is more convenient in some cases.

Figure 20:
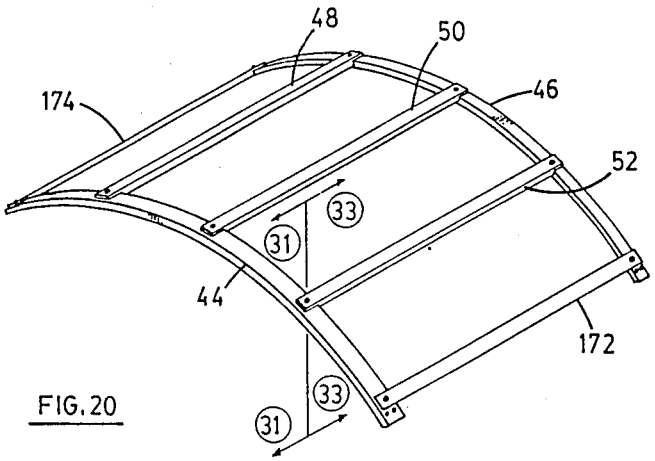
FIG. 20 shows an alternative embodiment of the upper arcuate assembly of FIGS. 1 to 4.

In FIG. 20, is an alternative embodiment of the upper arcuate assembly, comprising additional cross members 172, and 174.

Figure 21:
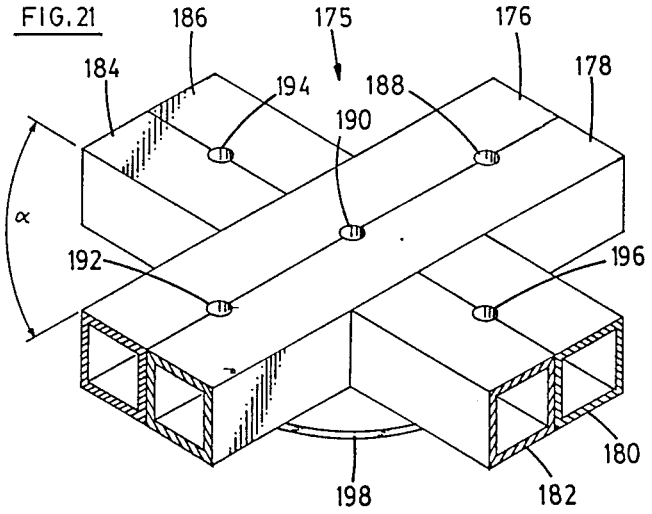
FIGS. 21 and 22 show an alternative center piece to that shown in FIGS. 5 to 8.
Figure 22:
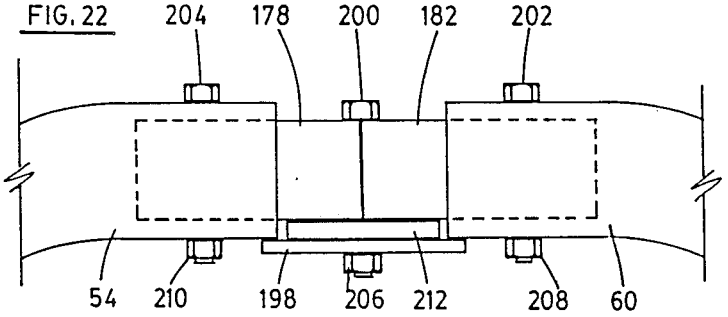

In FIGS. 21 and 22 is shown center piece 175 an alternative embodiment of that shown as 62 in FIGS. 5 to 8. Center piece 62 receives the arcuate members internally within the cross arms. Center piece 175 cross arms are received within the arcuate members. Center piece 175 comprises square tubes 176 and 178 welded together, stub square tubes 180 and 182 are similarly welded together, as are stub square tubes 184 and 186, these stub square tubes are welded to tubes 176 and 178 to form an angled cross, not usually right angled, but at the indicated angle α. Holes 188, 190 and 192 to receive bolts are drilled through the abutting inner walls of the tubes 176 and 178, hole 194 is drilled through the abutting walls of 184 and 186, hole 196 is drilled through the abutting walls of 180 and 182. A spacer plate 212 is welded to the bottom of center piece 175, spacer plate 212 does not extend beyond the square tubing. In use the inner ends of arcuate members, 54 and 60 shown, are slid over the four projecting arms and as shown, bolt 204 secures arcuate member 54 through hole 192, and is fastened by nut 210, bolt 202 secures arcuate member 60 through hole 196, and is fastened by nut 208, bolt 200 is passed through hole 190 and secures cover plate 198 fastened by nut 206, similar securing is applied to the other arcuate members.

Figure 23:
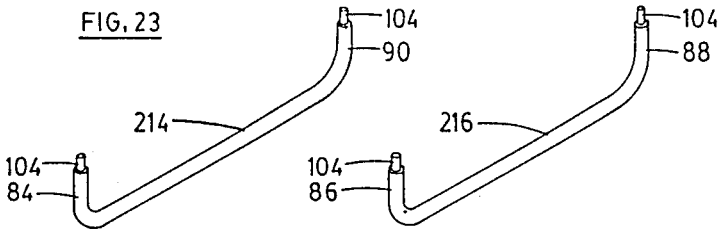
FIGS. 23 to 25 show alternative embodiments of base arrangements to that shown in FIGS. 9 and 10.
Figure 24:
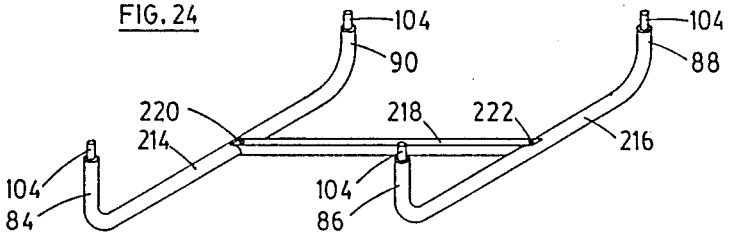
Figure 25:
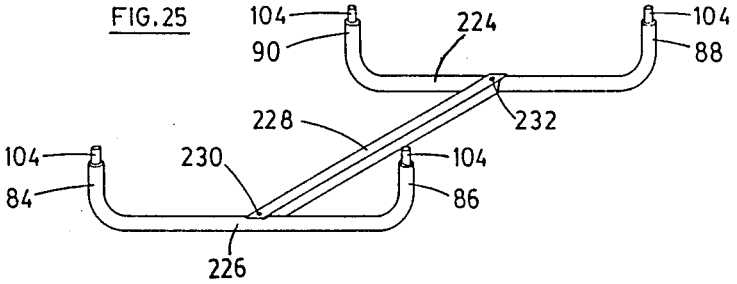

FIGS. 23 to 25 show alternative embodiments to the base arrangement of FIGS. 9 and 10, in these embodiments uprights 84, 86, 88 and 90 with their projections 104 remain unchanged. FIG. 23 shows an alternative embodiment, where the floor contacting base has two longitudinal members 214, and 216. FIG. 24 shows another alternative embodiment where transverse member 218 connects longitudinal members 214 and 216, secured by bolts 220 and 222 respectively. FIG. 25 shows a further alternative embodiment, wherein the floor contacting base has two transverse members 224 and 226, longitudinal member 228 connects these, secured by bolts 230 and 232. These alternative embodiments may be used instead of that of FIGS. 9 and 10.

Figure 26:
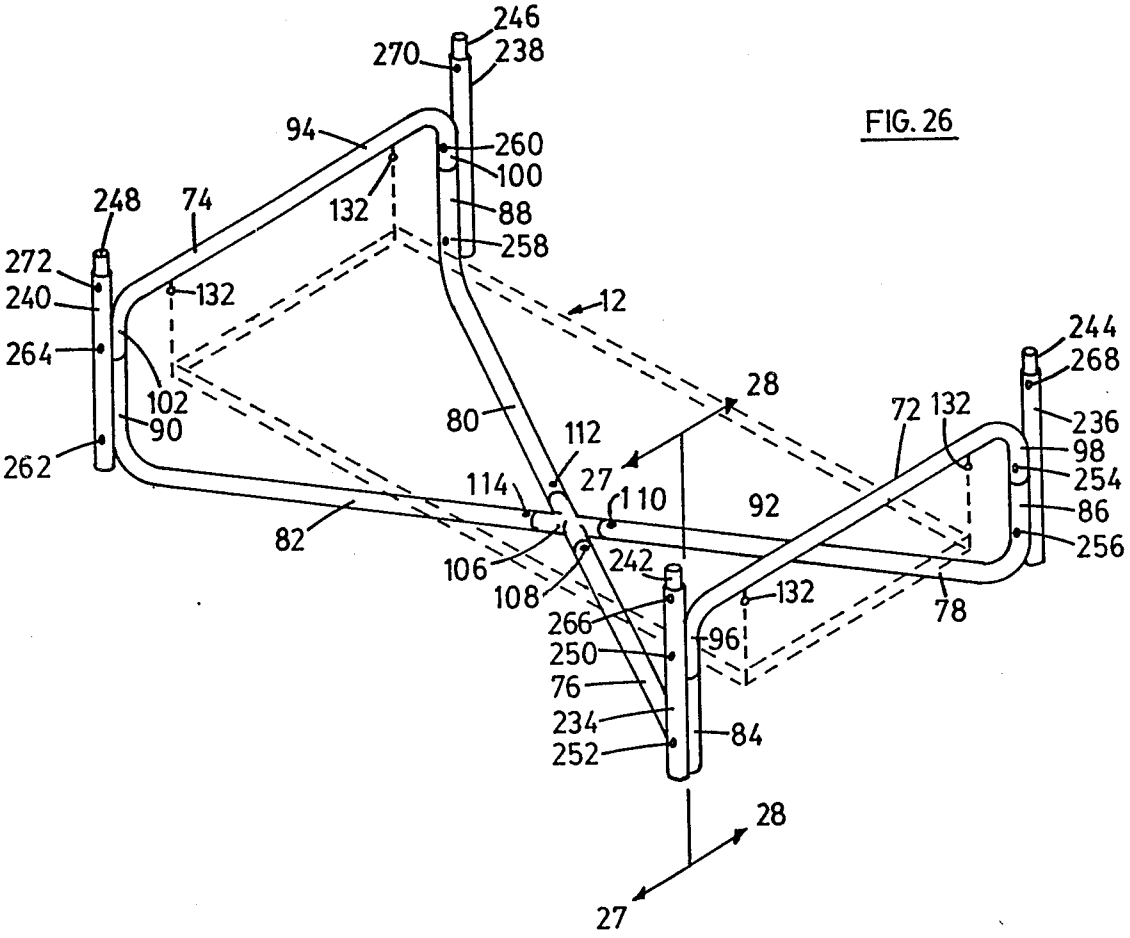
FIG. 26 shows a related embodiment to that of FIGS. 9 and 10, FIGS. 27 and 28 show sectional views of alternative embodiments of this embodiment.

FIG. 26 shows a base arrangement as in FIGS. 9 and 10, with outer upright tubes 234, 236, 238, 240 fastened to inner upright tubes 84 and 96, 86 and 98, 88 and 100, and 90 and 102 by pins or bolts 250, 252, 254, 256, 258, 260, 262, 264. These pins or bolts pass through both outer and inner tubes to secure them in position. Male projections of lesser diameter 242, 244, 246, 248, terminate the upper ends of outer uprights 234, 236, 238, and 240 respectively, these are adapted to receive tubes of the same diameter as the outer uprights, which tubes form superstructures similar to those shown in FIGS. 1 to 8. Pins or bolts 266, 268, 270 and 272, fix these projections to the outer uprights.

Figure 28:
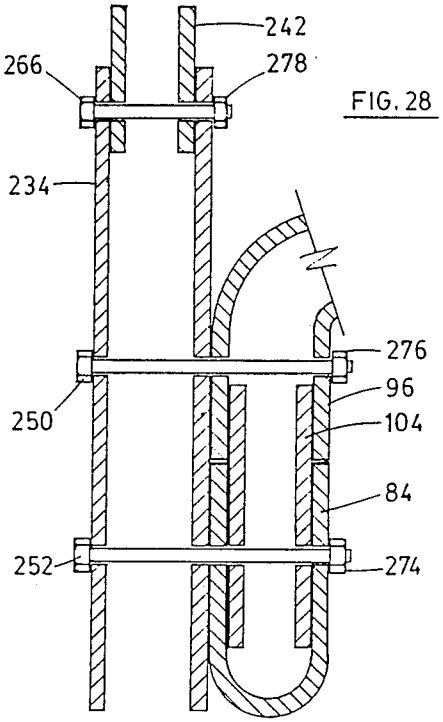
Figure 27:
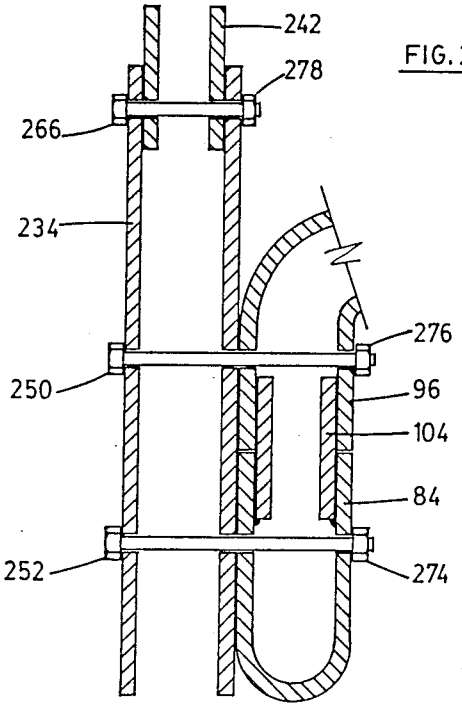

FIGS. 27 and 28 show sectional views of alternative embodiments of the joined inner and outer uprights 84, 96 and 234. FIG. 27 shows 104 as a stub inner tube welded within tube 84, bolt 252 and nut 274 secure outer upright 234 to tube 84, bolt 250 and nut 276 secure outer upright 234 to tube 96, bolt 266 and nut 278 secure stub inner tube 242 within 234. FIG. 28 shows a variation wherein 104 is an internal tube resting on the bottom curve of 84, otherwise the securing arrangements are the same.

FIG. 29 shows a similar upper assembly to FIG. 20 with parallel arcuate circular tubes, 280 and 282 which in this embodiment have vertical terminal sections 284, 286, 288, 290 adapted to fit over the inner tubes 242, 244, 246 and 248 of FIG. 26.

FIG. 30 shows a similar upper assembly to FIGS. 5 to 8, with diagonal arcuate circular tubes 292, 294, 296, 298, joined by center piece 300, which is similar in structure and function to center piece 106 shown in FIG. 13. tubes 292, 294, 296, 298 have vertical terminal sections 302, 304, 306, 308 adapted to fit over the inner tubes 242, 244, 246 and 248 of FIG. 26.

Figure 31:
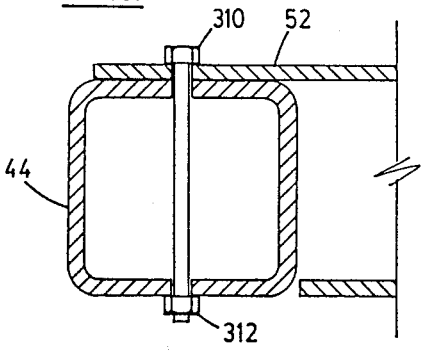
FIGS. 31 to 39 show various securing embodiments utilized in the practice of the invention.
Figure 32:
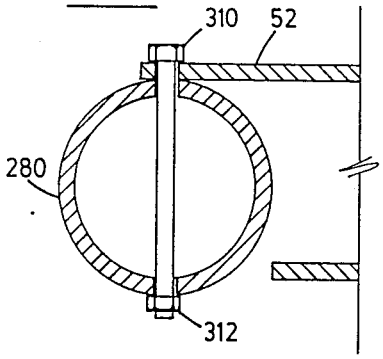

FIGS. 31 and 32 show the mode of securing cross members, 52 shown of the parallel arcuate upper assembly to the parallel arcuate members 44 and 280, using bolt 310 and nut 312.

Figure 33:
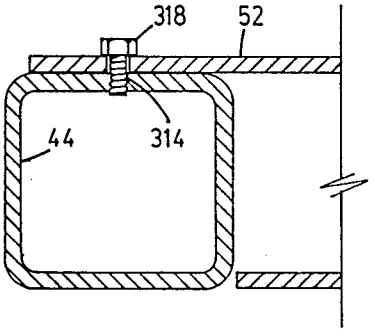
Figure 34:
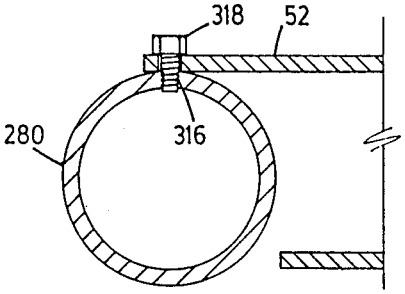

FIGS. 33 and 34 show another mode of securing the same members, where threads 314 and 316 have been tapped into parallel arcuate members 44 and 280 to receive bolts 318.

Figure 35:
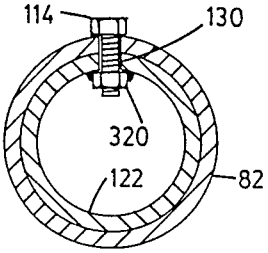
Figure 36:
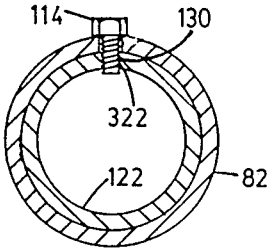

FIGS. 35 and 36 show methods of securing center piece 106 to arm 82, in FIG. 35 nut 320 is welded to arm 122 of center piece 106 at base of hole 130, to receive bolt 114, in FIG. 35 hole 130 has thread 322 to receive bolt 114.

Figure 37:
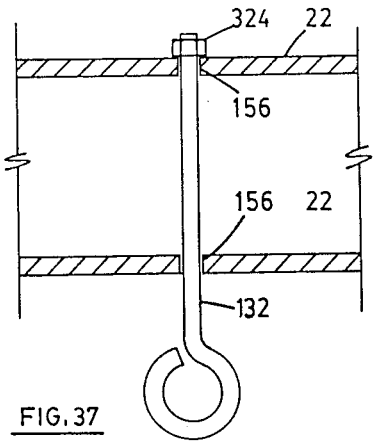
Figure 38:
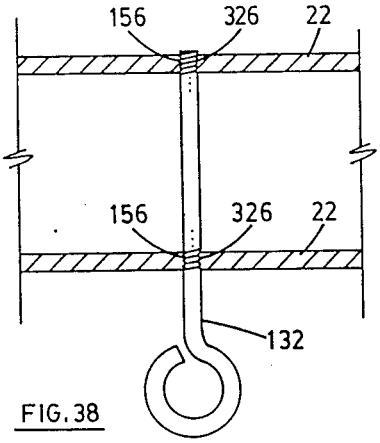
Figure 39:
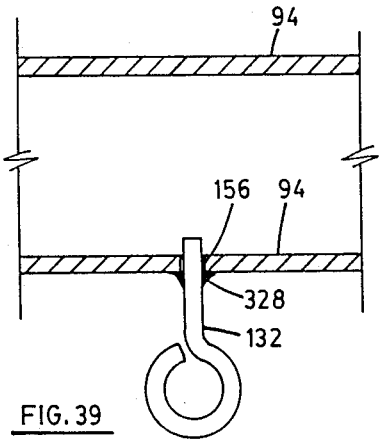

FIGS. 37 to 39 show methods of securing eyebolts 132 to a cross member 22 or 94, in FIG. 37 eyebolt 132 passes through holes 156 in cross member 22, and is secured in position by nut 324. In FIG. 38, the holes 156 of member 22 contain threads 326 to engage eyebolt 132. In FIG. 39 eyebolt 132 is welded into hole 156 in member 94 by bead 328.

Figure 40:
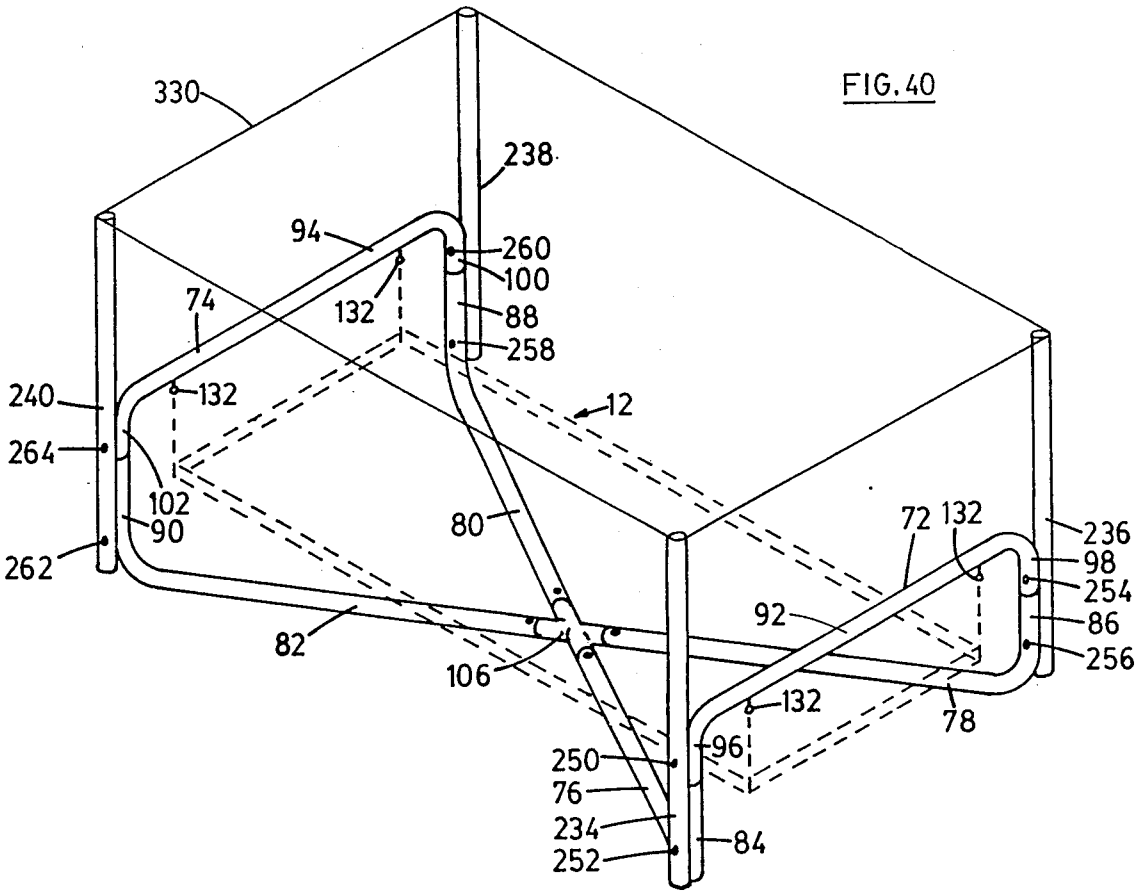
FIG. 40 shows an alternative embodiment of the invention.

FIG. 40 shows an alternative embodiment to that of FIG. 26, in this embodiment, the outer uprights 234, 236, 238 and 240 have been extended upward, to a reasonable height, cable, or wire 330 is secured to the top of these uprights to allow a canopy to be placed thereon.

Figure 41:
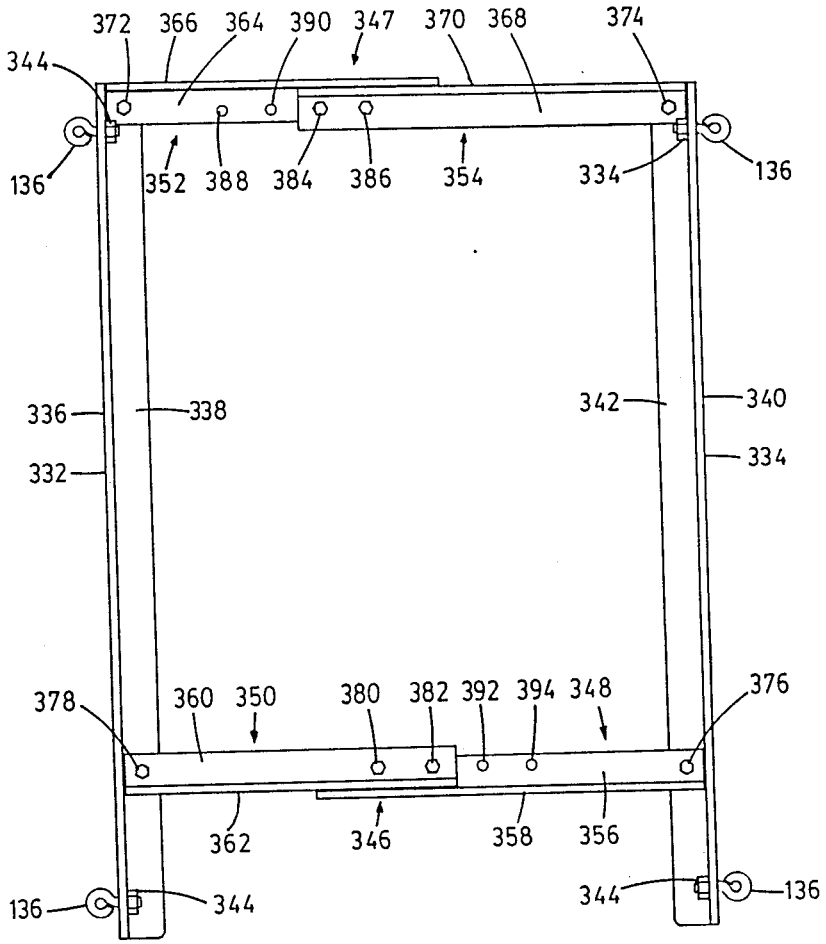
FIG. 41 shows a plan view of a preferred form of bed frame.

FIG. 41 shows a preferred bed frame, frame 12 has two side rails 332 and 334 of angle iron type having upright flanges 336 and 340 to which eye bolts 136 are secured by nuts 344, and horizontal flanges 338 and 342. Cross braces 346 and 347 complete the frame, which are formed by connected upper head brace 354 and lower head brace 352, and connected upper foot brace 350 and lower foot brace 348, which are also formed from angle iron, the upright flanges 358, 362, 366 and 370 are not perforated while the lower brace horizontal flanges 352 and 356 have five holes, four at one end and one at the other, while the upper brace horizontal flanges 360 and 368 have three holes, two at one end and one at the other. The single holes at one end are used to fasten the outer ends of the cross braces 348, 350, 352, and 354 by bolts 376, 378, 372 and 374 respectively to side rail flanges 338 and 342. The two holes of upper braces 350 and 352 have the same spacing as the four holes of lower braces 348 and 354, and thus the length of the cross braces 346 and 347 can be adjusted to fit various bed widths. As illustrated the bed frame 12 is at maximum width, bolts 380 and 382 secure upper brace 350 to lower brace 348, while bolts 384 and 386 secure upper brace 354 to lower brace 352, holes 388 and 390 are visible in flange 364, while holes 392 and 394 are visible in flange 356.

As those skilled in the art would realise these preferred illustrated dimensions, details and components can be subjected to substantial variation, modification, change, alteration, and substitution without affecting or modifying the function of the illustrated embodiments. Although embodiments of the invention have been described above, it is not limited thereto, and it will be apparent to persons skilled in the art that numerous modifications and variations form part of the present invention insofar as they do not depart from the spirit, nature and scope of the claimed and described invention.

I claim:

1. A support structure for swaying support of a bed frame, comprising:

four horizontal lower support members (76,78,80,82) extending diagonally inward to a center position;

means (106,108,110,112,114) rigidly connecting inner ends of said lower support members at said center position;

a lower corner member (84,86,88,90) extending upwardly at an outer end of each lower support, integral with the lower support member;

two spaced parallel upper support members (92, 94) each having an integral downwardly extending upper corner member (96,98,100,102) at each end;

means (104) rigidly connecting a lower end of each downwardly extending upper corner member to an upper end of a respective lower corner member;

first, spaced apart, attachment means (132) on each upper support member;

said first attachment means being adapted for attachment of suspension means for a rectangular bed frame.

2. A support structure as claimed in claim 1, said first attachment means being adapted to suspend a rectangular bed frame (12) including second attachment means (136) adjacent each corner of said frame, by suspension means (134) extending from said first attachment means to said second attachment means.

3. A support structure as claimed in claim 1, said lower and upper support members being of tubular form, said means rigidly connecting said inner ends of said lower support members comprising:

a cross member (106) comprising four arms, said arms being positioned in said inner ends of said lower support members, and fastening means (108,110,112,114) passing through holes in said arms and in said inner ends of said support members.

4. A support structure as claimed in claim 3, said fastening means comprising one of pins and bolts.

5. A support structure as claimed in claim 3, said means rigidly connecting said lower ends of said upper corner members to said upper ends of said lower corner members comprising an extension (104) on the upper end of each said lower corner member, each extension positioned in a lower end of an upper corner member.

6. A support structure as claimed in claim 1, including a further upright member (234,236,238,240) attached to each cooperative lower and upper corner member.

7. A support structure as claimed in claim 6, said further upright members attached to said upper and lower corner members by one of pins and bolts.

8. A support structure as claimed in claim 6, each said further upright member having an upwardly extending projection of an upper end thereof.

9. A support structure as claimed in claim 8, each said further upright member extending upwardly above said spaced parallel upper support member, for attachment of support means for a canopy.

* * * * *